US010720136B2

(12) United States Patent
Zalewski et al.

(10) Patent No.: US 10,720,136 B2
(45) Date of Patent: Jul. 21, 2020

(54) LAYERED CHAMBER ACOUSTIC ATTENUATION

(71) Applicant: ZIN TECHNOLOGIES, INC., Middleburg Heights, OH (US)

(72) Inventors: Bart F. Zalewski, Lakewood, OH (US); William B. Dial, Cuyahoga Falls, OH (US)

(73) Assignee: ZIN TECHNOLOGIES, INC., Middleburg Heights, OH (US)

( * ) Notice: Subject to any disclaimer, the term of this patent is extended or adjusted under 35 U.S.C. 154(b) by 241 days.

(21) Appl. No.: 15/830,627

(22) Filed: Dec. 4, 2017

(65) Prior Publication Data

US 2019/0172437 A1 Jun. 6, 2019

(51) Int. Cl.

| | |
|---|---|
| ***G10K 11/172*** | (2006.01) |
| ***E04B 1/84*** | (2006.01) |
| ***G10K 11/168*** | (2006.01) |
| *G10K 11/16* | (2006.01) |
| *E04B 1/82* | (2006.01) |

(52) U.S. Cl.

CPC ..... *G10K 11/168* (2013.01); *G10K 11/172* (2013.01)

(58) Field of Classification Search

CPC ..... G10K 11/172; G10K 11/16; E04B 2001/8433; E04B 2001/848; E04B 2001/8485; E04B 2001/849; E04B 2001/8495; E04B 2001/8476; E04B 1/82; E04B 1/8209; E04B 1/8227

See application file for complete search history.

(56) References Cited

U.S. PATENT DOCUMENTS

| | | | | |
|---|---|---|---|---|
| 1,969,704 A | | 8/1934 | D'Alton | |
| 3,819,009 A | * | 6/1974 | Motsinger | F02C 7/045 181/292 |
| 3,848,697 A | * | 11/1974 | Jannot | F02K 1/827 181/220 |
| 3,910,374 A | * | 10/1975 | Holehouse | G10K 11/172 181/292 |
| 3,983,955 A | * | 10/1976 | Vasiljevic | G10K 11/16 181/285 |
| 4,106,587 A | * | 8/1978 | Nash | F02K 1/827 181/213 |
| 5,930,371 A | * | 7/1999 | Cheng | F01N 1/023 381/71.5 |

(Continued)

OTHER PUBLICATIONS

Noah H. Schiller, et al., "Sound Transmission Loss Through a Corrugated-Core Sandwich Panel With Integrated Acoustic Resnators"; Journal, Proceedings of the ASMe 2014 International Mechanical Engineering Congress & Exposition IMECE2014, Nov. 14-20, 2014, 9 pgs.

(Continued)

*Primary Examiner* — Edgardo San Martin
(74) *Attorney, Agent, or Firm* — Tarolli, Sundheim, Covell & Tummino LLP

(57) ABSTRACT

An acoustic attenuation device includes resonator panels stacked in a thickness direction of the device. Each resonator panel is tuned to a different frequency range and includes a plurality of openings through which excited air resonates. The resonator panels are placed adjacent to other resonator panels such that all openings are accessible to the environment.

12 Claims, 6 Drawing Sheets

(56) References Cited

U.S. PATENT DOCUMENTS

| | | | | |
|---|---|---|---|---|
| 5,959,265 | A * | 9/1999 | Van Ligten | G10K 11/172 181/286 |
| 6,069,840 | A | 5/2000 | Griffin et al. | |
| 6,435,303 | B1 * | 8/2002 | Warnaka | E04B 1/86 181/286 |
| 6,892,856 | B2 * | 5/2005 | Takahashi | G10K 11/172 181/284 |
| 7,413,053 | B2 * | 8/2008 | Wasif | F23M 20/005 181/210 |
| 7,913,813 | B1 * | 3/2011 | Mathur | G10K 11/172 181/290 |
| 8,006,802 | B2 * | 8/2011 | Honji | G10K 11/172 181/293 |
| 9,224,380 | B2 * | 12/2015 | Shiozawa | G10D 3/02 |
| 9,378,721 | B2 | 6/2016 | Zalewski et al. | |
| 9,624,791 | B2 * | 4/2017 | Weir | F02K 1/827 |
| 9,697,817 | B2 | 7/2017 | Zalewski et al. | |
| 10,140,968 | B2 * | 11/2018 | Ayres | E04B 1/86 |
| 2019/0139529 | A1 * | 5/2019 | Viard | G10K 11/172 |

OTHER PUBLICATIONS

Steven A. Lane, et al., "Chamber Core Structures for Fairing Acoustic Mitigation"; Journal Article; Journal of Spacecraft and Rockets, vol. 44, No. 1 Jan.-Feb. 2007; 8 pgs.

Albert R. Allen, et al., "Transmission Loss and Absorption of Corrugated Core Sandwich Panels With Embedded Resonators"; Journal, Noise-Con 2014, Sep. 8-10, 2014, 8 pgs.

* cited by examiner

LAYERED CHAMBER ACOUSTIC ATTENUATION

GOVERNMENT FUNDING

This invention was made with government support under Contract No. NNC14CA02C awarded by The National Aeronautics and Space Administration. The United States government has certain rights to the invention.

TECHNICAL FIELD

This disclosure relates generally to acoustic attenuation and, more specifically, relates to a layered acoustic attenuator and related method.

BACKGROUND

Current mitigation technologies of low frequency spectrum attenuation include acoustic hangers, Helmholtz resonators, chamber core resonators, coverage tube resonators, large volume resonators, and large mass systems. In tube resonators, the frequency is dictated by the length of each chamber therein, which can be limited where size constraints exist. Existing broad band acoustic resonators are composed of a series of narrowband resonators that only act in broad band over a large area. Consequently, spatial constraints can limit the ability of the resonator to attenuate a wide enough band.

SUMMARY

This disclosure relates generally to acoustic attenuation.

In one example, an acoustic attenuation device includes resonator panels stacked in a thickness direction of the device. Each resonator panel is tuned to a different frequency range and includes a plurality of openings through which excited air resonates. The resonator panels are placed adjacent to other resonator panels such that all openings are accessible to the environment.

DETAILED DESCRIPTION

This disclosure relates generally to acoustic attenuation and, more specifically, relates to a layered acoustic attenuator and related method. The device can be used to attenuate a wide range of low frequencies, such as in the range from about 10 Hz to about 320 Hz (or various low frequency ranges below about 400 Hz), where either large volume resonators or large mass systems are traditionally used. Furthermore, the device advantageously provides wide broad band, low frequency attenuation in a reduced spatial footprint compared to existing attenuators due to the stacked (e.g., layered) panel configuration. This space efficiency advantage stems from the capability of the device to attenuate a wide range of frequencies locally and not only from a gross standpoint. This affects the attenuation of sound for locally sensitive components.

The device mitigates acoustic noise by utilizing acoustic chambers, each with one or more openings, which act as resonators and allow molecules of a fluid therein to vibrate through the openings. While the examples disclosed herein describe the fluid as air, it is understood that any fluid or combination of fluids can reside within the chambers, which can depend on the environment where the attenuator device is used. Thus, the fluid can be any substance that flows, which can include liquids, e.g., water, oil, gasoline, and/or gases, e.g., air or its constituents. The initially stationary air inside of a chamber is excited by a pressure wave and moves outside of the chamber through an opening. As the air exits the opening, it creates a pressure differential between the inside and outside of the chamber, thereby forcing the air to move back inside the chamber through the same opening. The air continues to vibrate through the opening at the chamber's resonant frequency—analogue to a tuned mass damper—which dissipates acoustic energy.

The device is capable of attenuating low frequency noise over a wide band by stacking or layering panels having these acoustic chambers on one another in the thickness direction of the device. This can be in the up/down or left/right direction, depending on the orientation of the device in use.

Figure 1:
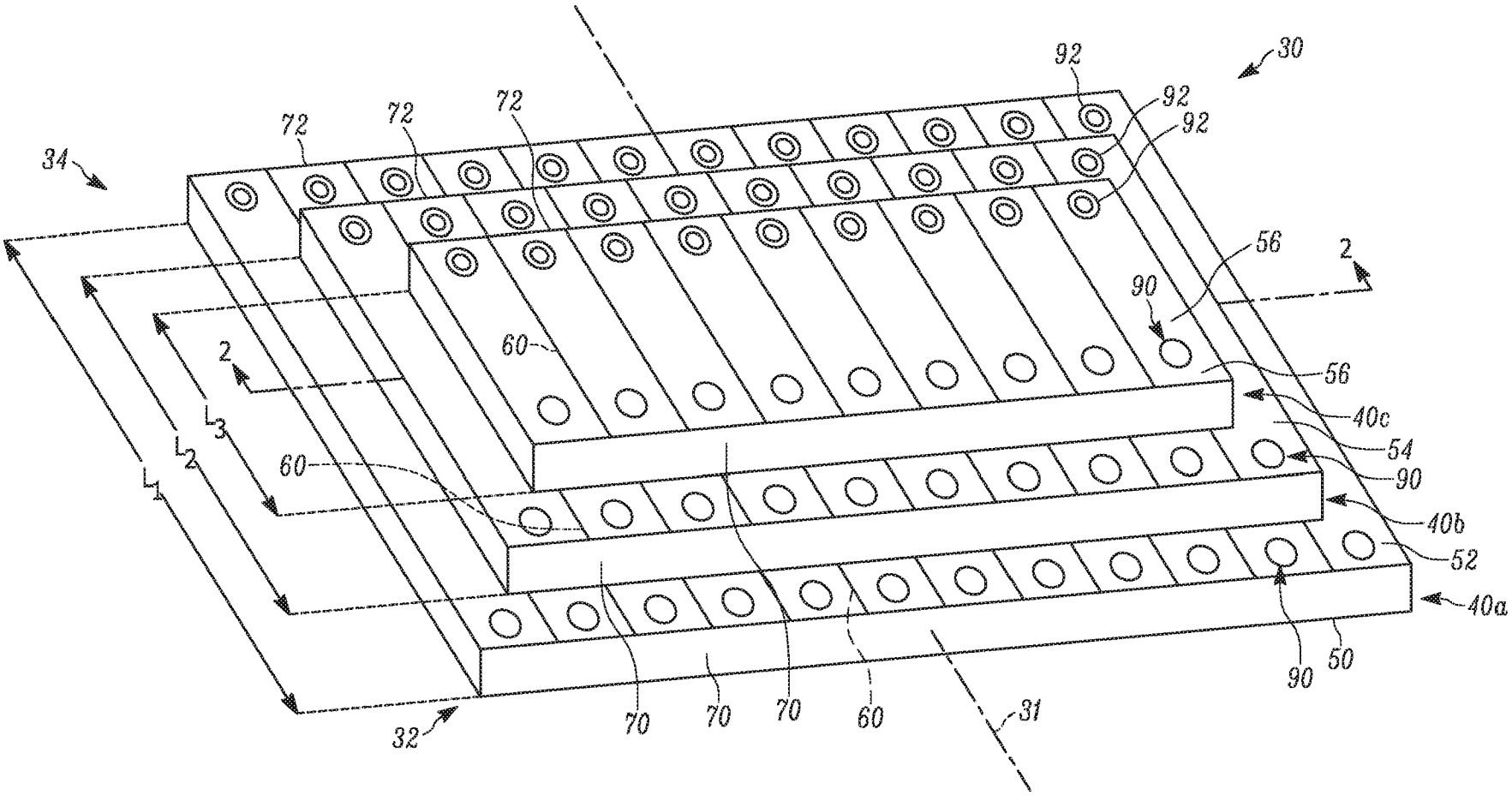
FIG. 1 illustrates an example of a layered chamber attenuator device.
Figure 2:
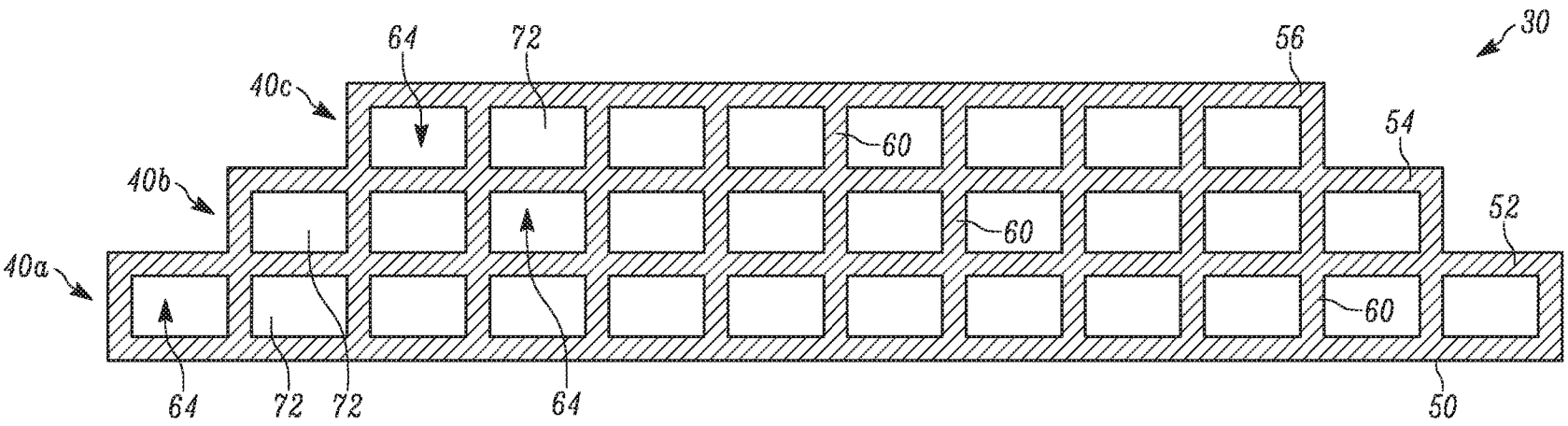
FIG. 2 illustrates a sectional view of the attenuator device of FIG. 1 taken along line 2-2.

FIGS. 1-2 illustrate an example of an acoustic attenuation device (e.g., resonator) 30. The device 30 extends generally along a centerline or axis 31 from a first end 32 to a second end 34. The device 30 includes a plurality of panels 40 stacked or layered on one another in a direction generally perpendicular to the centerline 31 (vertically as shown). Although first, second, and third panels 40*a*, 40*b*, 40*c* are shown, the device 30 can have more or fewer panels.

In this example, the first panel 40*a* includes a first sheet 50 and a second sheet 52 that are each substantially planar. The first and second sheets 50, 52 can have substantially the same length as one another. The first and second sheets 50, 52 can be parallel to one another or can extend at angles relative to one another (not shown). Although the sheets 50, 52 are illustrated in FIG. 1 as being planar and extending parallel to one another, in other examples, either or both sheets can be curved or contoured in one or more directions (not shown).

As used herein, the term "substantially" is intended to indicate that while the property or condition modified by the term can be a desirable property or condition, some variation can occur. In this context, for example, the term "substantially planar" demonstrates that the sheet can be a flat sheet, although it can exhibit some minor curves, protrusions or other variations apart from being completely flat.

The first and second sheets 50, 52 are spaced apart from one another by a plurality of webs 60 (FIG. 2) extending along or substantially parallel to the axis 31. The webs 60 can also extend at an angle(s) relative to one another and/or be curved in one or more directions (not shown). The webs 60 cooperate within the first and second sheets 50, 52 to define a plurality of sound attenuation chambers 64 within the first panel 40*a* extending along and parallel to the axis 31.

In one example, each chamber 64 has a substantially rectangular cross-section, although alternative cross-sectional shapes (e.g., elliptical, trapezoidal or the like) are contemplated herein. It will also be appreciated that any chamber 64 can have a constant cross-section or a cross-section that varies along the length of the chamber. In any case, the chambers 64 define a predetermined volume and mass of fluid that resonates upon excitation. One or more panels 70 close the chambers 64 at the first end 32 of the device 30. One or more panels 72 close the chambers 64 at the second end 34 of the device 30. The end sheets 70, 72 extend parallel to one another such that the chambers 64 can each have the same length $L_1$. In another example (not shown), the panel 40*a* is configured to have a non-rectangular shape, e.g., triangular or trapezoidal, such that the chambers 64 have different lengths.

It is possible that the panel 40*a* can be comprised of a single chamber 64 or multiple chambers, i.e., discrete chamber(s) or interconnected chambers extending back and forth between the first and second ends 32, 34. If multiple, interconnected chambers 64 are used to form a single resonator 30, one or more openings 63 (see phantom in FIG. 4) between the chambers can be constructed in the webs 60. It will therefore be appreciated that the chamber 64 in the first panel 40*a* can be a single, uninterrupted volume between the ends 32, 34 having a length substantially equal to the sum of the lengths $L_1$ of each individual chamber.

Referring to FIG. 1, a series of openings 90, 92 extends through the second sheet 52 at each end 32, 34 of the device 30 for providing a fluid communication pathway between the chambers 64 and the environment outside the first panel 40*a*. For example, a set of first openings 90 is located near an edge corresponding to the panel 70. A set of second openings 92 is located near the opposing edge corresponding to the panel 72. Each first opening 90 can have any shape, e.g., round, square or polygonal, and be sized the same as or different from any other first opening. As shown in the example of FIG. 1, each first opening 90 is round and has the same diameter $d_1$ (see FIG. 4) as every other first opening. The size and shape of the first openings 90 is fixed (e.g., invariable) once the device 30 is fully assembled.

As a further example, the end sheets 70, 72 and sheets 50, 52 are hermetically sealed to one another such that the first and second openings 90, 92 are the only way by which fluid, e.g., air, can enter or exit the first panel 40*a*. Each second opening 92 can be round, square or have any other shape. The second openings 92 can be the same as one another for each chamber 64 (as shown) or can be different from one another across different chambers.

In some examples, each second opening 92 in the first panel 40*a* is located closer to an end of each respective chamber 64 opposite the corresponding first opening 90 to maximize the length over which the excited air can attenuate within the respective chamber. In one example, the chambers 64 are configured to have a frequency spacing of about 3 Hz relative to one another to help limit the effects of anti-peak on the sound attenuation. In this configuration, each second opening 92 is different from every other second opening in the first panel 40*a*. Each individual second opening 92, jointly with the associated first opening 90, results in each individual chamber 64 in the first panel 40*a* having a different resonant frequency. In one example, each individual second opening 92 has a permanent, prescribed opening such that the resonant frequency of each chamber 64 in the first panel 40*a* is fixed.

Figure 3B:
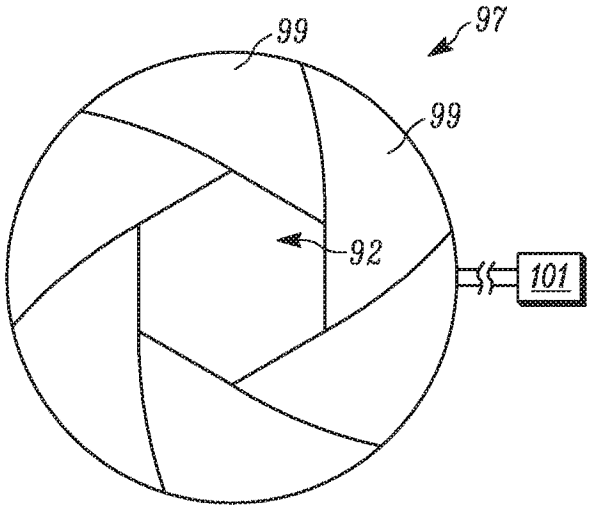
FIG. 3B illustrates a top view of the example adjustable opening in the attenuator device of FIG. 1 in a second condition.
Figure 3A:
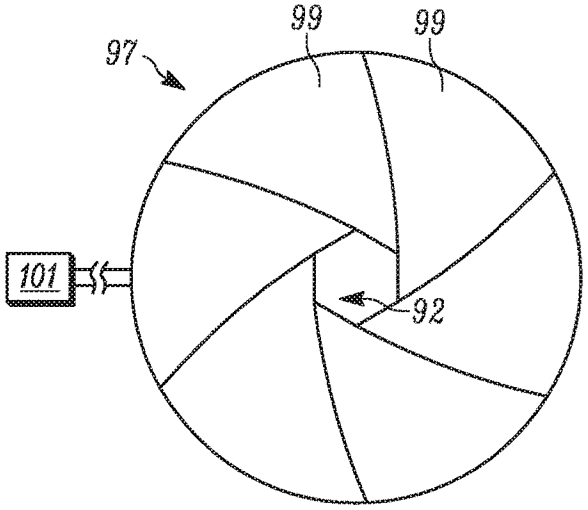
FIG. 3A illustrates a top view of an example adjustable opening in the attenuator device of FIG. 1 in a first condition.

The second openings 92 differ from the first openings 90 in that the cross-section of the second openings is passively or actively adjustable. Referring to FIGS. 3A-3B, a frequency tuning mechanism 97 is associated with each second opening 92 for adjusting the amount of air that can flow through the second opening. As one example, the mechanism 97 includes a series of retractable and extendable leaves 99 that operate in a manner similar to a camera shutter in order to adjust the cross-section of the second opening 92. The spacing of a radially inner edge of the leaves 99 from the center of the associated second opening 92 is variable to change the size and shape of each second opening. The leaves 99 therefore also move relative to one another to change the spacing therebetween. The leaves 99 can have any desired size and shape to define the second openings 92, e.g., generally triangular or fin-shaped as shown. The mechanism 97 alternatively can include sliding or pivoting doors that cover varying degrees of the openings 92 (not shown).

The mechanism 97 can be associated with each second opening 92 in any number of ways, e.g., connected to the top and/or bottom of the second sheet 52 adjacent each second opening or provided in a recess (not shown) in the second sheet surrounding each second opening. The mechanism 97 can be integrally formed with the second sheet 52 or a separate component secured thereto.

A controller 101 or other means is electrically connected to the mechanism 97 to facilitate operation of all mechanisms associated with the second openings 92. In one example, each mechanism 97 includes a motor or actuator (not shown) connected to the leaves 99 and adjustable by the controller 101. FIG. 3A shows a first condition of one mechanism 97, in which the leaves 99 are extended radially towards one another and towards the center of the second opening 92 to reduce the cross-sectional size of the second opening. As a result, the frequency of the chamber 64 is decreased. FIG. 3B shows a second condition of the mechanism 97, in which the leaves 99 are retracted radially away from the center of the second opening 92 to increase the cross-sectional size of the second opening. As a result, the frequency of the chamber 64 is increased. Since the second openings 92 can have any shape, it will be understood that the leaves 99 of the associated mechanism 97 are configured to form the desired shape and size for each second opening.

The mechanism 97 enables active or dynamic frequency tuning for the panel 40*a*. In an active resonator, the size of the first openings 90 is fixed and the size of each second opening 92 dynamically varies, depending on the desired frequency for the particular chamber 64. For example, the controller 101 responds to user input or a signal from one or more sensors (not shown) in the first panel 40*a* and actuates the leaves 99 to actively vary the size of one or more second openings 92. In this way, the controller 101 can adjust each second opening 92 in the first panel 40*a* to the same or different sizes, depending on the frequency content of the acoustic source being attenuated. The mechanism 97 can control the leaves 99 either passively or actively to adjust the cross-sections of the second openings 92. Consequently, the size of any second opening 92 can be independently varied to specifically tailor the resonant frequencies of the first panel 40*a*.

Figure 4:
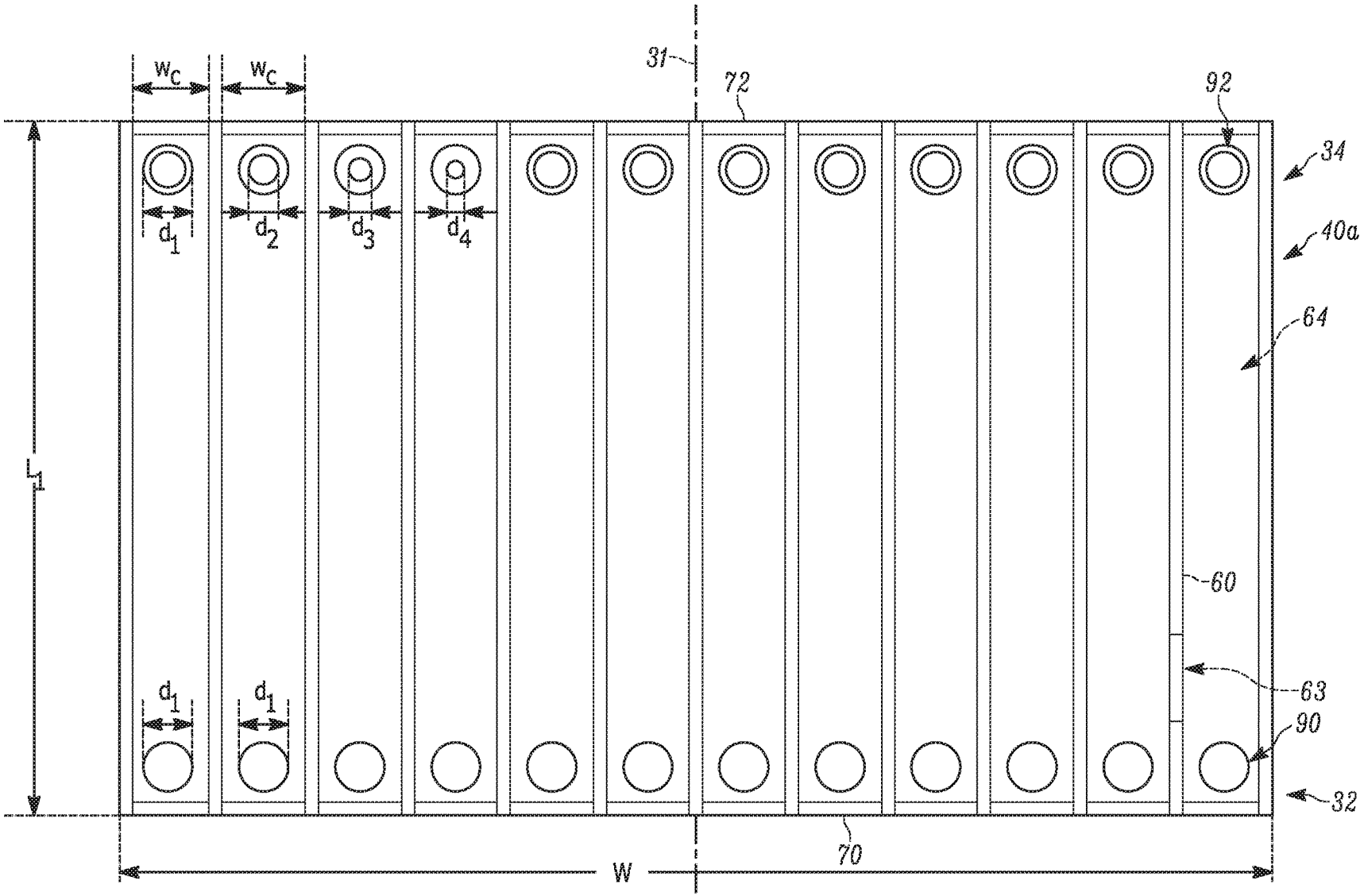
FIG. 4 illustrates a top section view of a panel of the attenuator device of FIG. 1.

In some examples, each second opening 92 is individually tuned to the same or different cross-sections to provide desired attenuation for one or more frequency ranges in the first panel 40*a*. In FIG. 4, for instance, the mechanisms 97 define second openings 92 having different cross-sections $d_2$, $d_3$, $d_4$ from one another. In other examples, the cross-sections $d_2$, $d_3$, $d_4$ of the second openings 92 may be adjusted together and to the same cross-section. Once the size(s) of the second openings 92 have been set, they may be fixed to such size, e.g., by applying an adhesive, a locking mechanism or the like to the leaves 99. In other examples, the leaves 99 may remain movable relative to one another and thereby adjustable to enable future tuning of the second openings 92. Such adjustment can be accomplished actively using a microphone and a feedback system with a motor adjusting the leaves 99.

Referring back to FIG. 1, the second and third panels 40*b*, 40*c* are constructed similarly to the first panel 40*a*. Structure in the second and third panels 40*b*, 40*c* corresponding to the same structure in the first panel 40*a* is given the same reference number. The description of the second and third panels 40*b*, 40*c* is abbreviated.

That said, the second panel 40*b* is formed from the second sheet 52 and a third sheet 54. For example, the second sheet 52 forming the top of the first panel 40*a* also forms the bottom of the second panel 40*b*. The webs 60 connected to and extending between the sheets 52, 54 define the chambers 64 in the second panel 40*b*. The end sheets 70, 72 are hermetically sealed to the sheets 52, 54 and webs 60 to close the ends of each chamber 64 in the second panel 40*b* in a fluid-tight manner. A set of the first, fixed openings 90 extends through the third sheet 54 adjacent the end sheet 70 in the second panel 40*b*. A set of the second, adjustable openings 92 extends through the third sheet 54 adjacent the end sheet 72 in the second panel 40*b*. The second openings 92 in the second panel 40*b* are connected to the controller 101 used to adjust the second openings 92 in the first panel 40*a*.

The second panel 40*b* differs from the first panel 40*a* in that the chambers 64 in the second panel have a length $L_2$ that is less than the length $L_1$ of the chambers in the first panel. In other words, the second panel 40*b* is shorter than the first panel 40*a*. The length $L_2$ and the position of the second panel 40*b* relative to the first panel 40*a* is chosen such that the second panel is spaced from all the openings 90, 92 in the first panel 40*a*. Consequently, the openings 90, 92 in the first panel 40*a* are exposed to the environment when the panels 40*a*, 40*b* are connected together.

The third panel 40*c* is formed from the third sheet 54 and a fourth sheet 56. The third sheet 54 therefore forms the top of the second panel 40*b* and the bottom of the third panel 40*c*. The webs 60 connected to and extending between the sheets 54, 56 define the chambers 64 in the third panel 40*c*. The end sheets 70, 72 are hermetically sealed to the sheets 54, 56 and webs 60 to close the ends of each chamber 64 in a fluid-tight manner. A set of the first, fixed openings 90 extends through the fourth sheet 56 adjacent the end sheet 70 in the panel 40*c*. A set of the second, adjustable openings 92 extends through the fourth sheet 56 adjacent the end sheet 72 in the third panel 40*c*. The second openings 92 in the third panel 40*c* are connected to the controller 101 used to adjust the second openings 92 in the first and second panels 40*a*, 40*b*.

The third panel 40*c* differs from the first and second panels 40*a*, 40*b* in that the chambers 64 in the third panel have a length $L_3$ that is less than both the length $L_1$ of the chambers in the first panel and the length $L_2$ of the chambers in the second panel. In other words, the third panel 40*c* is shorter than both the second panel 40*b* and the first panel 40*a*. The length $L_3$ and the position of the third panel 40*c* is chosen such that the third panel is spaced from all the openings 90, 92 in the second panel 40*b*. Consequently, the openings 90, 92 in the second panel 40*b* are exposed to the environment when the panels 40*b*, 40*c* are connected together. As a result, when the device 30 is assembled, a series of exposed first openings 90 are provided in each panel 40*a*, 40*b*, 40*c* along the first end 32 of the device and a series of exposed second openings 92 are provided in each panel 40*a*, 40*b*, 40*c* along the second end 34 of the device. It will be appreciated that any one or more of the openings 90, 92 in any of the panels 40*a*, 40*b*, 40*c* and associated with any chamber 64 could be positioned at either end 32, 34 of the device 30. For example, each chamber 64 in the device 30 has two openings 90, 92 exposed to the ambient conditions for receiving fluid therefrom.

In operation, the device 30 mitigates acoustic noise by utilizing the acoustic chambers 64 and associated openings 90, 92 in each panel 40*a*-40*c*, which act as resonators and allow excited air molecules to vibrate therethrough. The initially stationary air inside each chamber 64 is excited by a pressure wave and moves outside of the chamber through the associated opening pair 90, 92. As the air exits, it creates a pressure differential between the inside and outside of the chamber 64, thereby forcing the air to move back inside the chamber through the respective openings 90, 92. The air continues to vibrate through the openings 90, 92 based upon the chamber's resonant frequency—similar to a tuned mass damper—which dissipates the acoustic energy of the excited air. The chambers 64 are hermetically sealed from one another and, thus, vibrating air within one chamber does not pass to another chamber—either between chambers in the same panel 40 or between chambers in different panels. Rather, the air can only enter or exit each chamber 64 through the opening pair 90, 92 associated therewith.

The device 30 is configured to attenuate sound over a wide, low frequency range, e.g., about 10 Hz to 320 Hz (or various low frequency ranges below about 400 Hz), and can provide attenuation greater than 8 dB for every ⅓ octave within the frequency range. Each panel 40*a*-40*c* is configured to focus on a particular subset of the desired operating range of the device 30. For example, if a device 30 having three panels 40*a*-40*c* is intended to operate over a range over about 20 Hz to 160 Hz, the first panel 40*a* can be configured to attenuate sound over a frequency band of 20 Hz to 40 Hz, the second panel 40*b* can be configured to attenuate sound over a frequency band of 40 Hz to 80 Hz, and the third panel 40*c* can be configured to attenuate sound over a frequency band of 80 Hz to 160 Hz. These specific frequency band ranges can be discrete or overlap with one another. Regardless, the lengths $L_1$, $L_2$, $L_3$ of the chambers 64, the size of the first openings 90, and the state of the mechanisms 97 defining the second openings 92 are specifically coordinated and configured to provide the desired frequency band for each panel 40*a*-40*c* and collectively over the entire range, which may be continuous range of frequencies or not.

It will be appreciated that more or fewer than the three panels 40*a*-40*c* shown and described can be stacked/layered on one another in order to achieve the desired wide, low frequency range. For example, five panels 40 can be stacked on one another to form a device providing sound attenuation for frequencies between 10 Hz and 320 Hz. In such a construction, each respective panel 40 could cover the following frequency range: 10 Hz to 20 Hz, 20 Hz to 40 Hz, 40 Hz to 80 Hz, 80 Hz to 160 Hz, and 160 Hz to 320 Hz.

Figure 5:
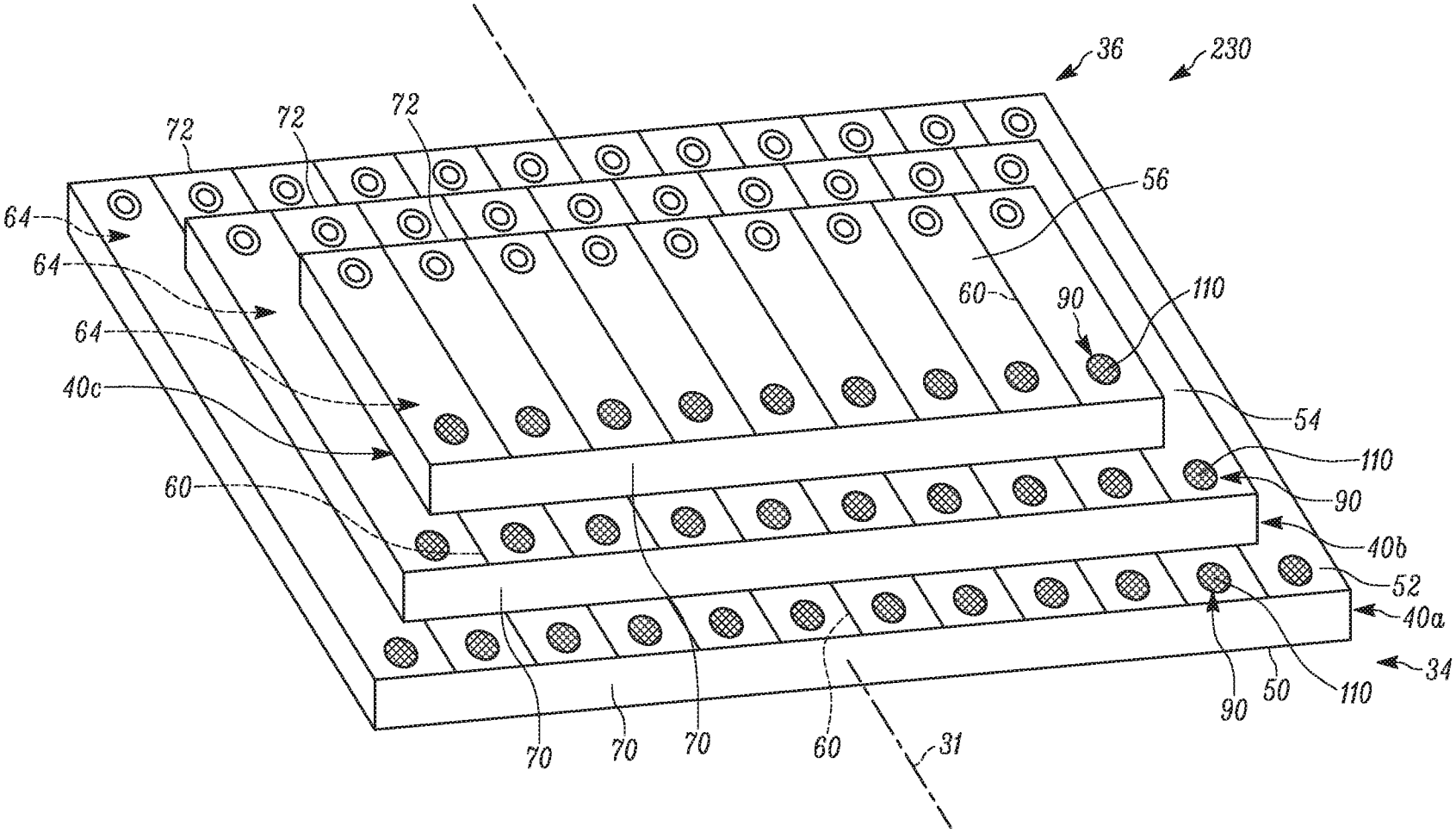
FIG. 5 illustrates the attenuator device of FIG. 1 with mesh over some openings.

FIG. 5 illustrates another device 230 in which at least some of the first openings 90 are covered by mesh 110. As shown, all the first openings 90 on each panel 40*a*-40*c* are covered by mesh 110. Alternatively, any number of the first openings 90—including zero—on each of the panels 40*a*-40*c* can be covered by mesh 110. The mesh 110 can be a three-dimensional, printed component integral with the sheets 52, 54, 56 or can be added, e.g., via ultrasonic welding, adhesive or other means of affixation, after the remainder of the device 230 is manufactured. The mesh 110 provides damping and widens the frequency range over which each chamber 64 within each panel 40*a*-40*c* attenuates. To this end, the pattern and/or density of the mesh 110 may be tailored to provide the desired degree of damping for each associated first opening 90.

Figure 6:
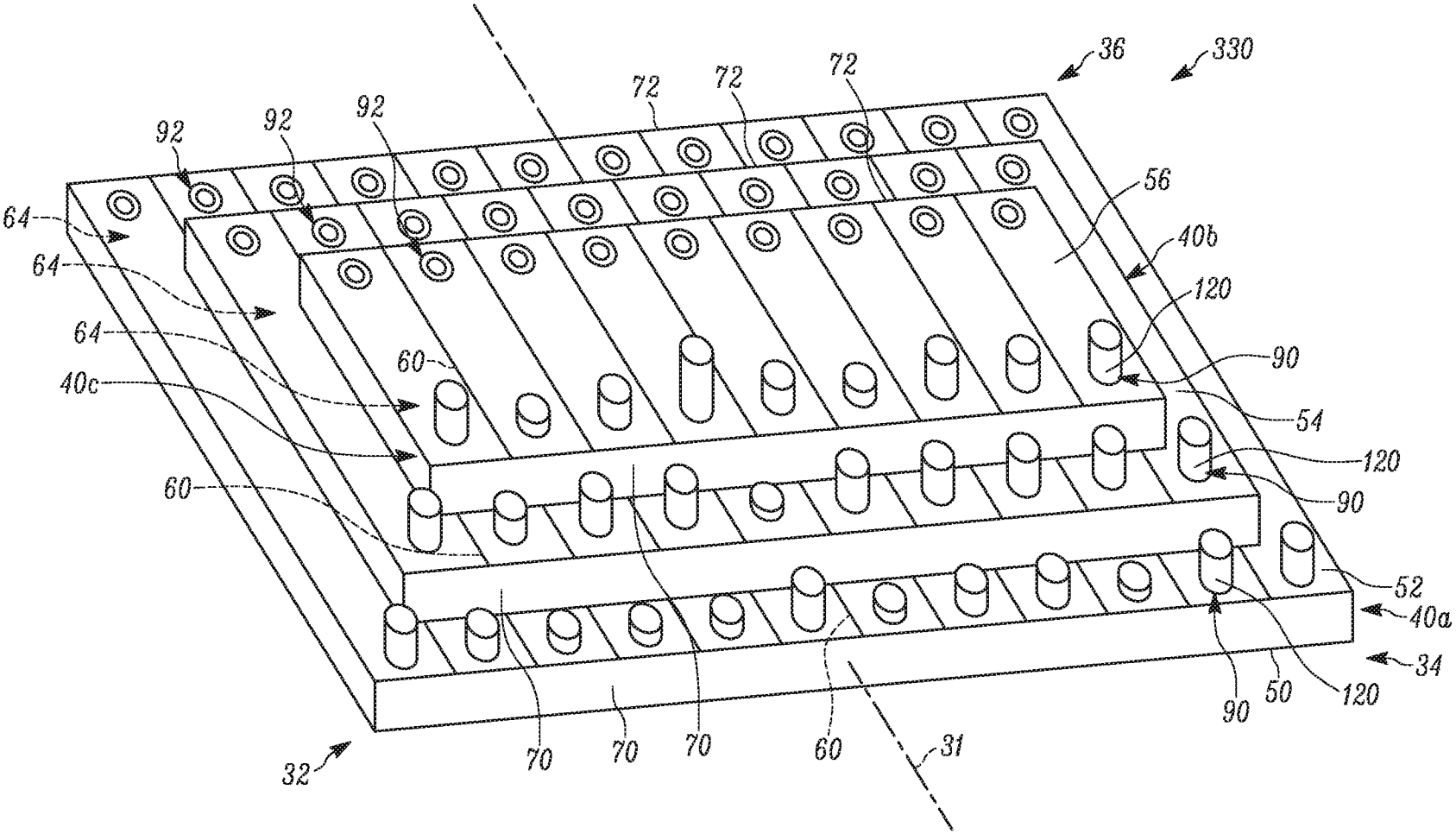
FIG. 6 illustrates the attenuator device of FIG. 1 with necks over some openings.

FIG. 6 illustrates another device 330 in which at least some of the first openings 90 are covered by tubular necks 120. The tubular necks 120 can be provided in lieu of or in addition to the mesh 110. The tubular necks 120 are integrally formed around the first opening 90 on each panel 40*a*-40*c* or added, e.g., via ultrasonic welding, adhesive or other means of affixation, after the remainder of the device 330 is manufactured. The necks 120 change the frequency of each respective chamber 64 and can be used for fine tuning the device 330 according to a desired range of frequencies to be attenuated. Thus, each neck 120 can have a particular height extending away from the respective sheet 52, 54, 56 to fine tune that specific chamber 64 accordingly.

Any number of the first openings 90 on any of the panels 40*a*-40*c*—including zero—can include a neck 120. Each neck 120 can be the same as or different from every other neck on the same panel 40*a*-40*c* and/or between panels. The mesh 110, when present, can be integrally formed with or secured over an opening of the neck 120. It will be appreciated that the mesh 110 and/or necks 120 can be used in any device shown or described herein.

The device provides a way to adjust the resonant frequency of the chambers 64 without adjusting the chamber length. The cross-section of each second opening 92 can be individually adjusted to provide resonant tuning for the particular chamber 64 in each panel 40*a*-40*c* that meets desired/required frequency for that specific application. The resonator frequency can be adjusted between the frequency corresponding to the length of the open tube resonator and the frequency corresponding to twice the length of the open tube resonator, or the length of the open-closed tube resonator. Therefore, for a tube resonator whose open-closed frequency is 100 Hz and whose open frequency is 200 Hz, the tuning can be performed for any frequency between about 100 Hz and 200 Hz. Due to this construction, broadband, low frequency attenuators can be manufactured that are less complex and less costly than traditional attenuators having resonators of different lengths. Furthermore, unlike the variable length attenuators described, the device can be adjusted or fine-tuned after being manufactured while maintaining a constant length for all the chambers 64 within each respective panel.

The device also greatly simplifies the manufacturing process of tube resonator panels. Traditionally, each individual resonator had to be made of a specific length, depending on its frequency. This is challenging for a large number of resonators, both from a logistical and technical standpoint. A resonator panel needs to accommodate two or more resonators per length and multiple resonators per width. Each resonator can, and usually does, have a unique length. Manufacturing such resonators in panels requires applying a series of stops along the length of the panel to separate it from appropriate resonators. Implementing all the resonators dividers at precise locations is time consuming and challenging. Moreover, the frequency of the resonator cannot be changed once the panel is built, eliminating a chance for any necessary corrections should the chamber length not match the desired resonator frequency.

This device mitigates the above-mentioned problems. For example, using the frequency tuning process described herein, all resonator chambers 64 can have the same length in the respective panel, which decreases tooling cost and the logistics of resonator layout design and manufacturing. The frequency tuning mechanism 97 also allows for tuning of the device after it has been manufactured. This is accomplished by adjusting the size of the second openings 92 associated with the chambers 64. The in-situ adjustment capability of the device allows for active tuning that was not possible in previous devices and which significantly improves attenuation and increases the frequency range of the device.

Figure 7:
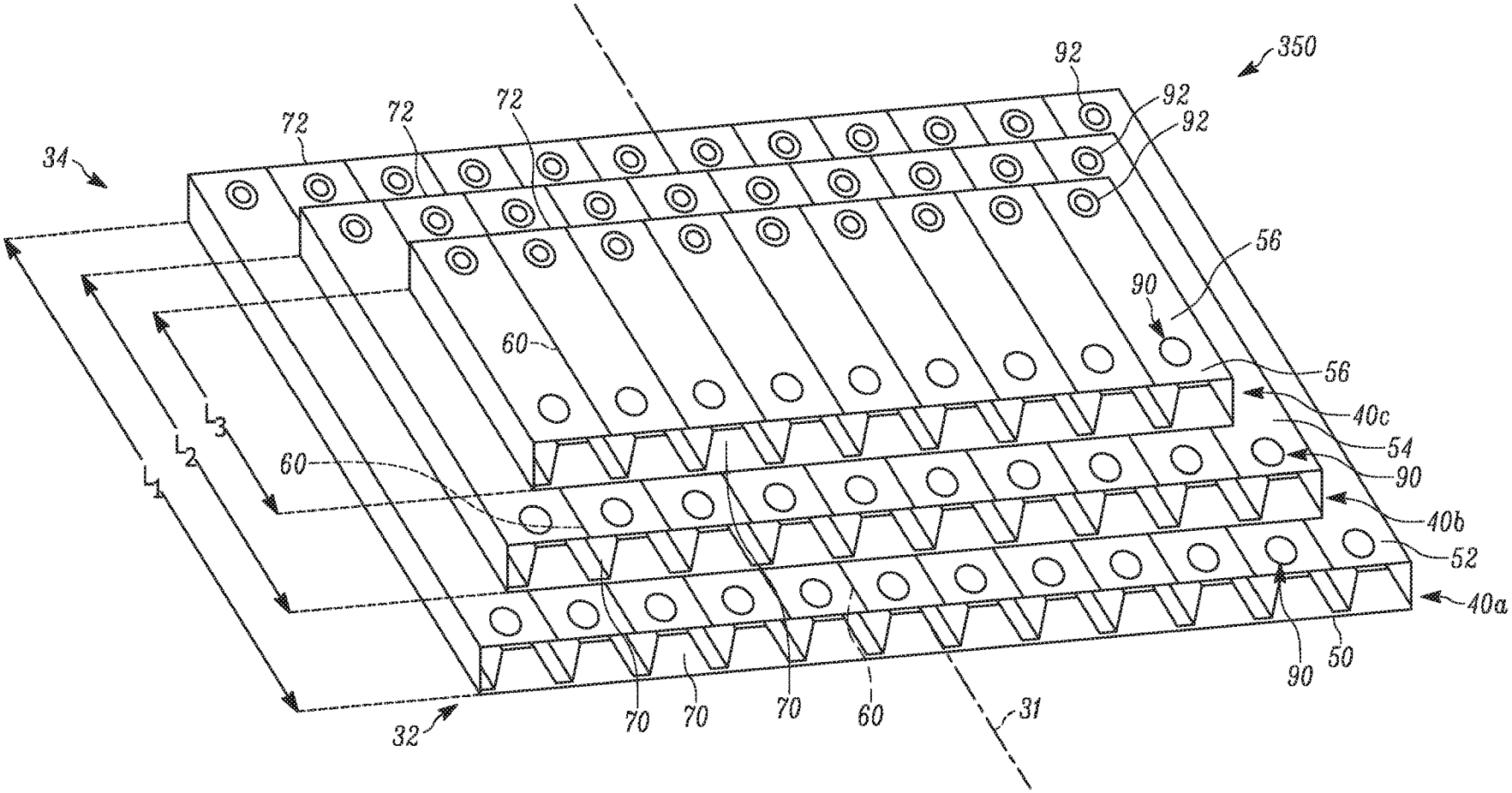
FIG. 7 illustrates a chamber attenuator device with a corrugated construction.

The device described herein can be used in broadband acoustic tube resonator panels, either stand alone or imbedded in structural panels 350 having a corrugated configuration (see FIG. 7). These panels 350 can be used on space launch vehicles to provide attenuation for payloads, engine components, or other sensitive equipment. The same broadband attenuation panels 350 can also be used in recording studios, yachts, boats, train cars, as walls/sound dampers in houses and apartment or commercial buildings, and as highway sound barriers. The devices can also be used for musical instruments where, instead of changing the acoustic length of a tube or having multiple tubes, the instrument can consist of one tube with two openings: one 90 of them fixed in cross-section and the other 92 having a cross-section that is adjustable via the tuning mechanism 97 to a desired frequency.

What have been described above are examples. It is, of course, not possible to describe every conceivable combination of components or method, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An acoustic attenuation device comprising resonator panels stacked in a thickness direction of the device, wherein each resonator panel is tuned to a different frequency range and includes a plurality of openings through which excited air resonates, the resonator panels being placed adjacent to other resonator panels such that all openings are accessible to the environment, wherein the device extends from a first end to a second end thereof and each resonator panel comprises:

first and second sheets;

a plurality of webs positioned between the first and second sheets and cooperating with the first and second sheets to form a series of sound attenuation chambers containing a volume and mass of fluid;

a first end sheet secured to the sheets and closing the chambers at the first end of the device;

a second end sheet secured to the sheets and closing the chambers at the second end of the device; and first and second openings of the plurality of openings associated with each chamber and through which excited air resonates, the first and second openings extending through the first sheet into each chamber, each first opening having an invariable cross-section and at least one of the second openings having an adjustable cross-section for varying a resonant frequency of the chamber.

2. The acoustic attenuation device of claim 1, wherein the chambers have the same length within the same resonator panel.

3. The acoustic attenuation device of claim 1, wherein the chambers in each resonator panel have a length different from the length of the chambers in each other resonator panel.

4. The acoustic attenuation device of claim 1, wherein the first sheet of each resonator panel forms the second sheet for the adjacent panel.

5. The acoustic attenuation device of claim 1 further comprising a frequency tuning mechanism associated with each second opening for adjusting the cross-section of each second opening.

6. The acoustic attenuation device of claim 5, wherein the frequency tuning mechanism comprises:

a plurality of leaves; and a controller to change a position the leaves to adjust the cross-section of each second opening.

7. The acoustic attenuation device of claim 6, wherein the leaves cooperate to form a shutter, a spacing from a radially inner edge of the leaves to a center of the second opening being variable by the controller.

8. The acoustic attenuation device of claim 1, wherein the cross-section of the second openings is adjustable after the device is fully assembled.

9. The acoustic attenuation device of claim 1 further comprising mesh extending over at least one of the first openings.

10. The acoustic attenuation device of claim 1 further comprising a tubular neck formed around at least one of the first openings.

11. The acoustic attenuation device of claim 1, wherein at least two of the second openings are different from one another.

12. The acoustic attenuation device of claim 1, wherein a total attenuation frequency range for the device is about 10 Hz to 320 Hz.

* * * * *